US005807186A

United States Patent [19]

Chen

[11] Patent Number: 5,807,186

[45] Date of Patent: Sep. 15, 1998

[54] GOLF CLUB INCLUDING LIE ADJUSTING DEVICE

[76] Inventor: Archer C. C. Chen, No. 501 28th Road Taichung Industrial Park, Taichung, Taiwan

[21] Appl. No.: 819,992

[22] Filed: Mar. 18, 1997

[51] Int. Cl.[6] ..... A63B 53/06

[52] U.S. Cl. ..... 473/248

[58] Field of Search ..... 473/246, 248

[56] References Cited

U.S. PATENT DOCUMENTS 5,377,980 1/1995 Hannon et al. ..... 473/248

*Primary Examiner*—George J. Marlo
*Attorney, Agent, or Firm*—Browdy and Neimark

[57] ABSTRACT

A golf club head is composed of a heel, a toe portion, a face, a sole, and a neck for fastening with the shaft of a golf club. The sole is provided with an adjusting apparatus detachably fastened therewith for adjusting an angle between an axis of said shaft and a bottom external surface of said adjusting means.

10 Claims, 3 Drawing Sheets

GOLF CLUB INCLUDING LIE ADJUSTING DEVICE

FIELD OF THE INVENTION

The present invention relates generally to a golf club head, and more particularly to a golf club head having a device for adjusting the lie, which is the angle formed between the ground surface and the center line of the shaft of the golf club when the sole of the club head is placed horizontally on the ground surface.

BACKGROUND OF THE INVENTION

Golf clubs are numbered in accordance with the lies. The golf clubs of various lies have shafts of various lengths. Accordingly, a golf player should select the golf club that is most suitable to him or her in consideration of his or her height. The lies of the conventional golf clubs can be adjusted to meet the requirements of a golf player. However, the lies of the conventional golf clubs can be adjusted to a very limited extent.

SUMMARY OF THE INVENTION

The primary objective of the present invention is to provide a golf club with a head having means for adjusting the lie in a range greater than that of the conventional golf club heads.

In keeping with the principle of the present invention, the foregoing objective of the present invention is attained by a golf club head, which comprises a neck, a heel, a face, a sole, and a toe portion. The sole of the present invention is provided with an adjusting device for adjusting the distance between the ground surface and the toe portion or the heel such that the lie of the golf club can be adjusted in a wide range.

DETAILED DESCRIPTION OF THE INVENTION

Figure 1:
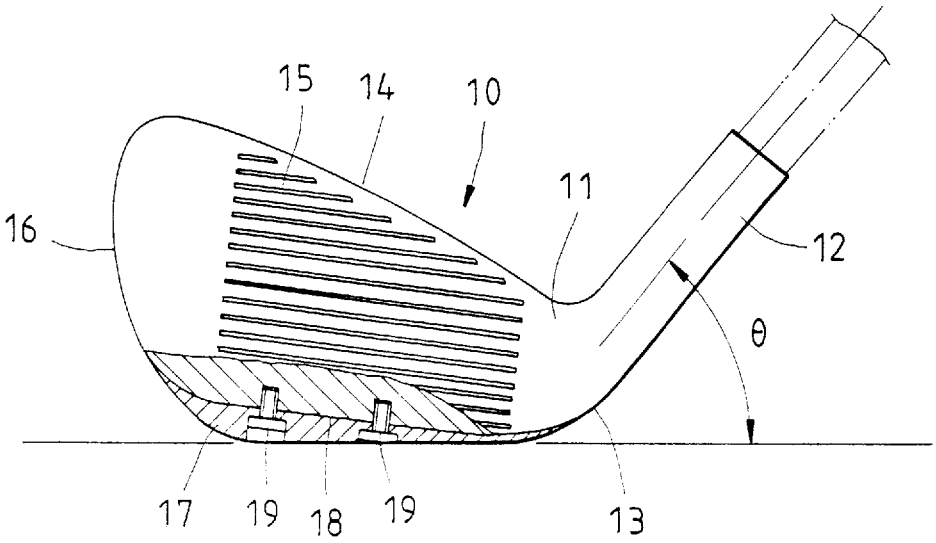
FIG. 1 shows a schematic view of a first preferred embodiment of the present invention.

As shown in FIG. 1, a golf club head 10 of the present invention has a body 11 which is composed of a neck 12, a heel 13, a top 14, a face 15, a toe portion 16, a sole 18, and a lie adjusting device 17 located in the sole 18. The lie adjusting device 17 is intended for use in adjusting the distance between the ground surface and the toe portion 16 or the heel 13 such that the lie θ formed between the center line of the shaft 12 and the ground surface is altered.

Figure 2:
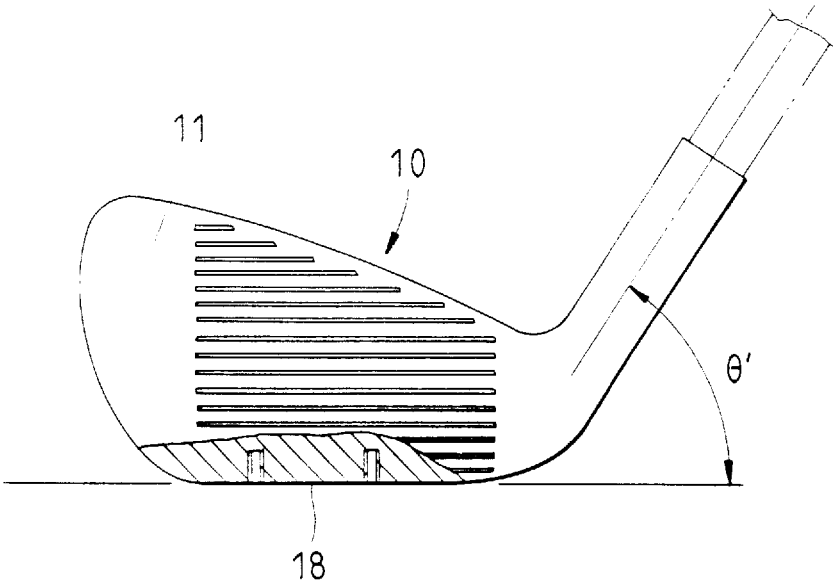
FIG. 2 shows a schematic view of the first preferred embodiment of the present invention with the lie adjusting device being removed.

The adjusting device 17 of the present invention is slightly wedge-shaped and is detachably fastened with the sole 18 by means of two bolts 19. As illustrated in FIG. 2, the sole 18 is free from the adjusting device 17. As a result, the lie θ' is different from the lie θ of FIG. 1. Moreover, the adjusting devices 17 of various shapes can result in the lies of various degrees.

Figure 3:
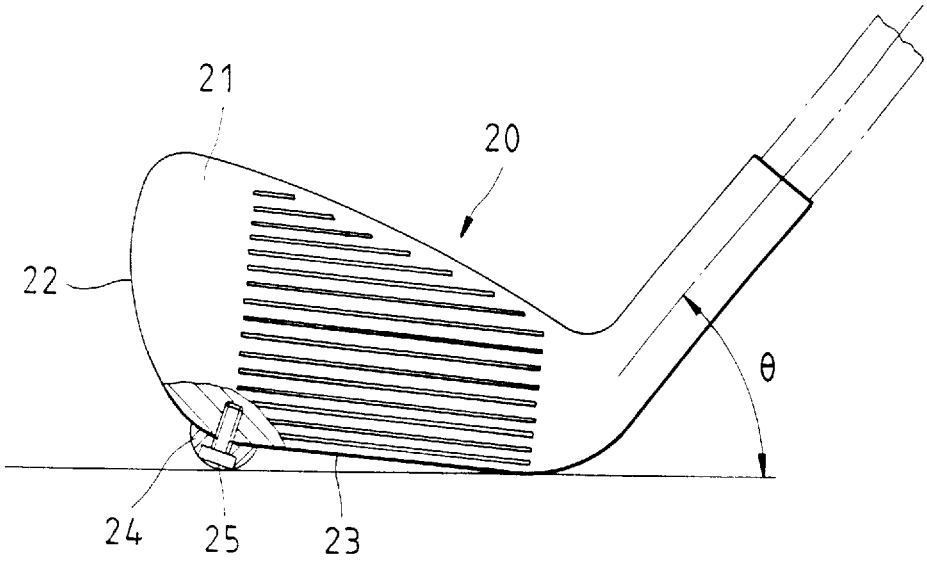
FIG. 3 shows a schematic view of a second preferred embodiment of the present invention.
Figure 4:
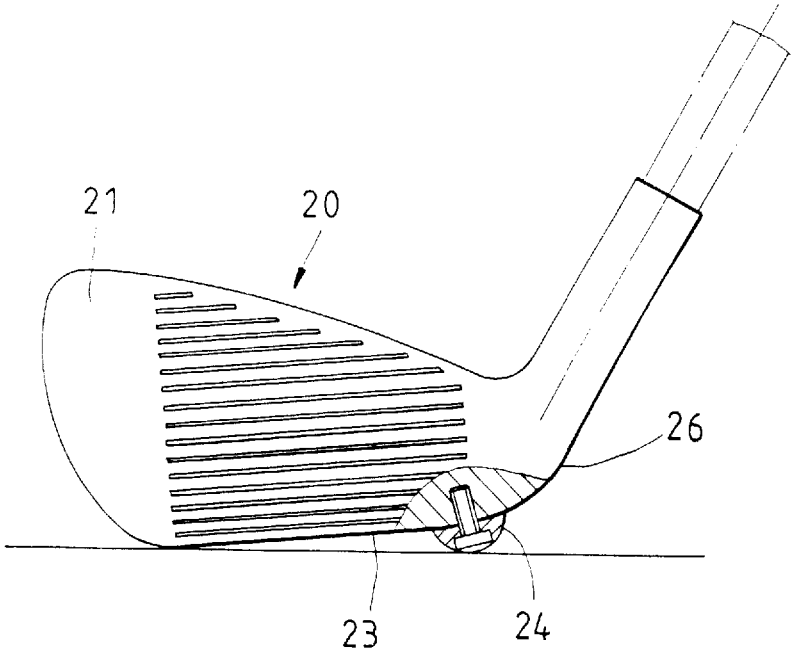
FIG. 4 shows another schematic view of the second preferred embodiment of the present invention.

As shown in FIG. 3, a golf club head 20 of the second preferred embodiment of the present invention has a body 21 provided with an adjusting device 24 which is detachably fastened with the bottom 23 of the toe portion 22 by means of a bolt 25. The shapes of the lie angle θ are dependent on the dimensions and the locations of the adjusting device 24. Accordingly, the adjusting device 24 may be located in the bottom 23 of the heel 26, as shown in FIG. 4.

Figure 5:
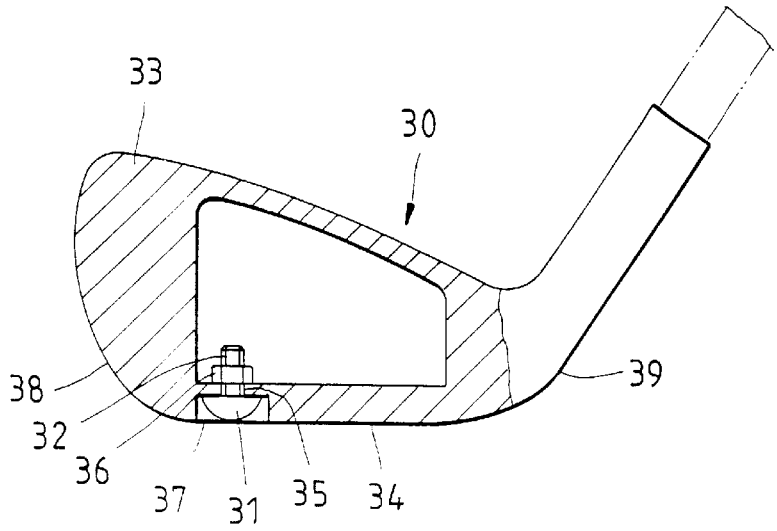
FIG. 5 shows a schematic view of a third preferred embodiment of the present invention.
Figure 7:
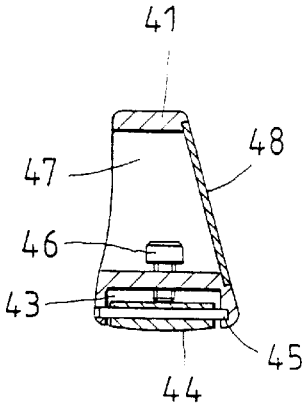
FIG. 7 shows a sectional view of a portion taken along a line 7—7 as shown in FIG. 6.

As shown in FIG. 5, a golf club head 30 of the third preferred embodiment of the present invention is different from the head 20 of the second preferred embodiment of the present invention in design in that the former is provided with an adjusting device 31 having a bolt 32 which is engaged with a threaded hole 35 of the sole 34 and is provided with a nut 36. The engagement depth of the bolt 32 can be adjusted by turning the nut 36, thereby resulting in the change in the shape of the lie angle. The threaded hole 35 is surrounded by a cavity 37 such that the adjusting device 31 is concealed. It must be noted here that the adjusting device 31 may be located in the vicinity of the toe portion 38 or the heel 39.

Figure 6:
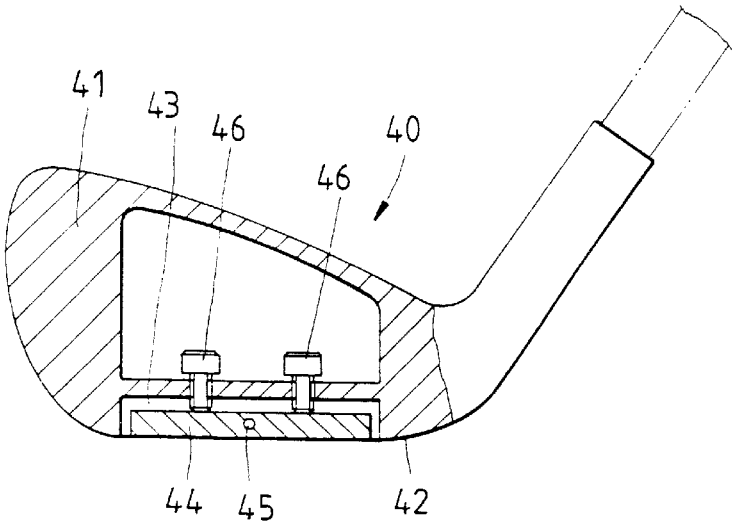
FIG. 6 shows a schematic view of a fourth preferred embodiment of the present invention.

As shown in FIG. 6, a golf club head 40 of the fourth preferred embodiment of the present invention comprises a sole 42 provided with an elongated cavity 43 in which an adjusting device 44 is located such that the device 44 is fastened pivotally with the head body 41 by a pivot 45, and that the adjusting device 44 can be adjusted by two adjustment bolts 46. As a result, the lie angles of various shapes can be obtained by adjusting the engagement depth of the adjustment bolts 46. The head body 41 has an open space 47 which is sealed off by a plate 48 to form a ball-striking face. As a result, the adjustment of the bolt 46 or the nut 36 can be done with a hand tool.

What is claimed is:

1. A golf club head comprising a neck to be fixed to a shaft of a golf club at a non-adjustable angle, said neck formed integrally to form said golf club head along with a heel, a sole, and a toe portion;

wherein, an adjusting means is engaged to a exterior surface of said golf club at said sole, said adjusting means being used to form an altered angle between an axis of said shaft and a bottom external surface of said adjusting means, wherein, the non-adjustable angle between the axis of the shaft and the sole of the golf club head remains the same.

2. The golf club head as defined in claim 1, wherein said adjusting means is detachably fastened with said sole by at least one bolt.

3. The golf club head as defined in claim 1, wherein said adjusting means is fastened with said sole such that said adjusting means is located under said toe portion.

4. The golf club head as defined in claim 1, wherein said adjusting means is fastened with said sole such that said adjusting means is located under said heel.

5. The golf club head as defined in claim 1, wherein said adjusting means is composed of an adjustment bolt; and wherein said sole has a hole for engaging said adjustment bolt of said adjusting means to permit said adjustment bolt to be adjusted in said hole of said sole.

6. The golf club head as defined in claim 5, wherein said adjustment bolt is provided with a nut fastened therewith within said golf club head for locating said adjustment bolt and for adjusting a depth level of said adjustment bolt inside said hole of said sole.

7. The golf club head as defined in claim 5, wherein said hole is surrounded by a cavity of a shape for concealing said adjusting means.

8. The golf club head as defined in claim 1, wherein said adjusting means is fastened in a cavity pivotally with said sole by a pivot, and that said adjusting means is provided with two adjustment bolts fastened therewith for adjusting the position of said adjusting means.

9. The golf club head as defined in claim 1, wherein said adjusting means has a variety of different shapes so as to alter the angle between the axis of said shaft and the bottom external surface of said adjusting means.

10. The golf club head as defined in claim 1, wherein the adjusting means is triangular in cross-section.

* * * * *